US009108777B1

(12) United States Patent
Santamarta

(10) Patent No.: US 9,108,777 B1
(45) Date of Patent: Aug. 18, 2015

(54) CHILD RESISTANT BLOW-FILL SEAL CONTAINER

(71) Applicant: Raimundo Jose Santamarta, Aventura, FL (US)

(72) Inventor: Raimundo Jose Santamarta, Aventura, FL (US)

(73) Assignee: SOLTECH INTERNATIONAL INC., Tortola (VG)

( * ) Notice: Subject to any disclaimer, the term of this patent is extended or adjusted under 35 U.S.C. 154(b) by 0 days.

(21) Appl. No.: 14/596,510

(22) Filed: Jan. 14, 2015

Related U.S. Application Data

(60) Provisional application No. 61/953,084, filed on Mar. 14, 2014.

(51) Int. Cl.
*B65D 47/00* (2006.01)
*B65D 50/06* (2006.01)

(52) U.S. Cl.
CPC ..... *B65D 50/066* (2013.01)

(58) Field of Classification Search
CPC ..... B65D 47/36; B65D 1/0238; B65D 1/095; A61J 1/1412; A61J 1/067
USPC ..... 215/209, 47, 250; 206/532
See application file for complete search history.

(56) References Cited

U.S. PATENT DOCUMENTS 2,868,419 A * 1/1959 Casey, Jr. ..... 222/402.12
3,370,733 A * 2/1968 Giesler ..... 206/446
3,628,680 A * 12/1971 Deaver ..... 215/221
4,995,519 A * 2/1991 Rose et al. ..... 215/47
5,221,029 A * 6/1993 Stull ..... 222/541.9
D492,406 S * 6/2004 Masuda et al. ..... D24/115
D492,407 S * 6/2004 Masuda et al. ..... D24/115
6,874,665 B2 * 4/2005 Doherty et al. ..... 222/541.5
D515,936 S * 2/2006 Ko ..... D9/696
D517,207 S * 3/2006 Poynter ..... D24/115
7,032,590 B2 * 4/2006 Loeffler et al. ..... 128/200.24
7,487,894 B2 * 2/2009 Zahn et al. ..... 222/541.9
8,047,394 B2 11/2011 Hansen
D684,259 S * 6/2013 Mehta ..... D24/115
8,464,918 B1 * 6/2013 Harris et al. ..... 222/541.6
8,833,576 B2 * 9/2014 Fontana ..... 215/47
2002/0100741 A1 * 8/2002 Weiler ..... 215/48
2002/0134377 A1 * 9/2002 Loeffler et al. ..... 128/200.24
2003/0146245 A1 * 8/2003 Weiler et al. ..... 222/420
2003/0155356 A1 * 8/2003 Fontana ..... 220/23.4
2009/0321382 A1 * 12/2009 Fontana ..... 215/329
2011/0082432 A1 * 4/2011 Fontana ..... 604/310

* cited by examiner

*Primary Examiner* — Anthony Stashick
*Assistant Examiner* — Ernesto Grano
(74) *Attorney, Agent, or Firm* — Ralph D. Chabot

(57) ABSTRACT

A child resistant container made from blow-molded plastic which comprises: a vial having an outlet port; a pre-determined volume of aseptic fluid disposed sealed within the vial; a cap detachable from the vial; and, a resilient guard having a first and second ends which are integral to the vial on opposing sides. The resilient guard is designed to not be separated from contact with the vial and has a mid-portion which is initially positioned above the top of the cap to prevent cap removal. The safety container is preferably single use.

17 Claims, 3 Drawing Sheets

FIG. 1
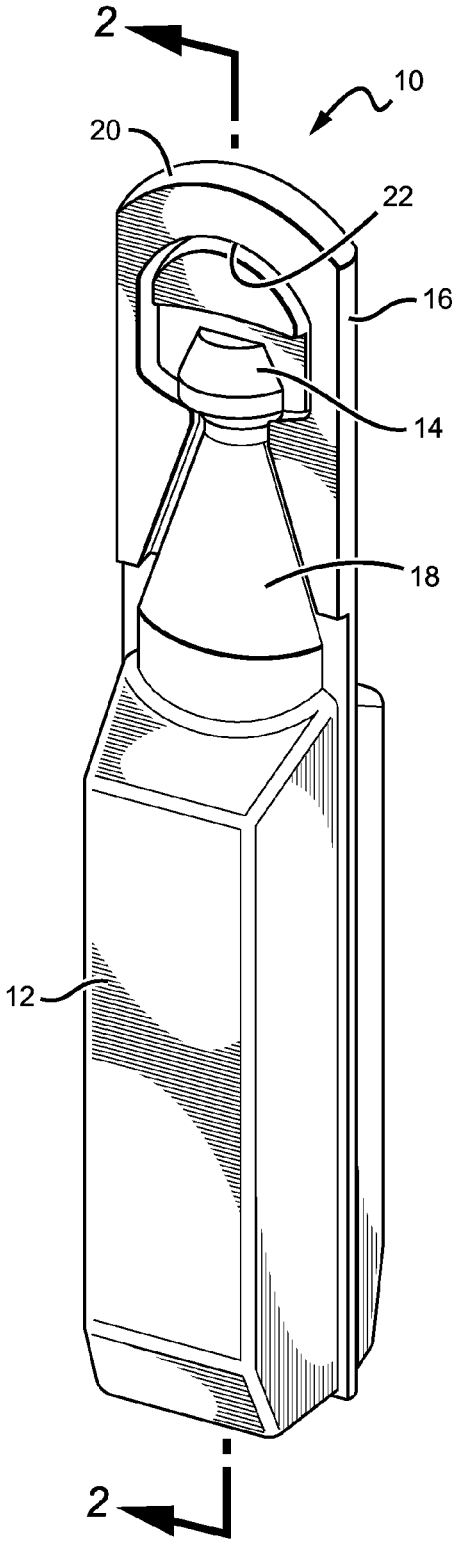
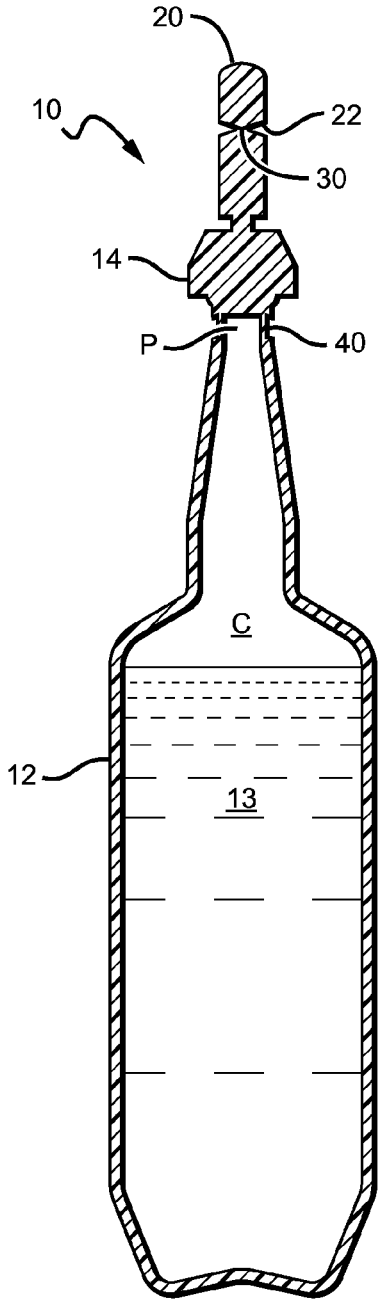
FIG. 2

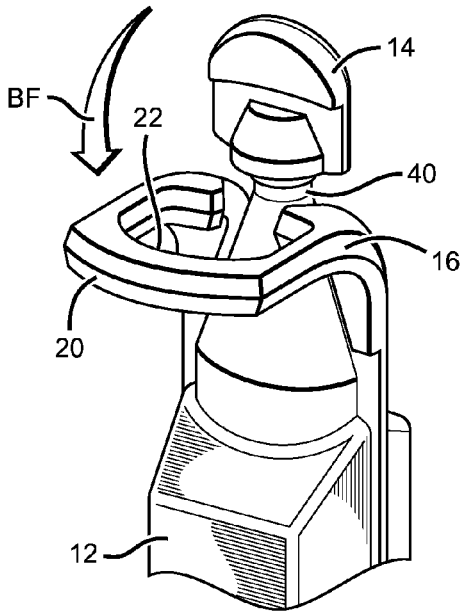
FIG. 3
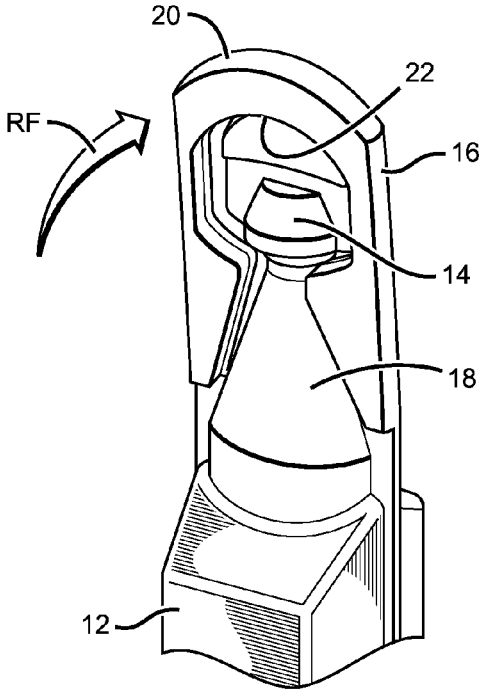
FIG. 5
FIG. 4
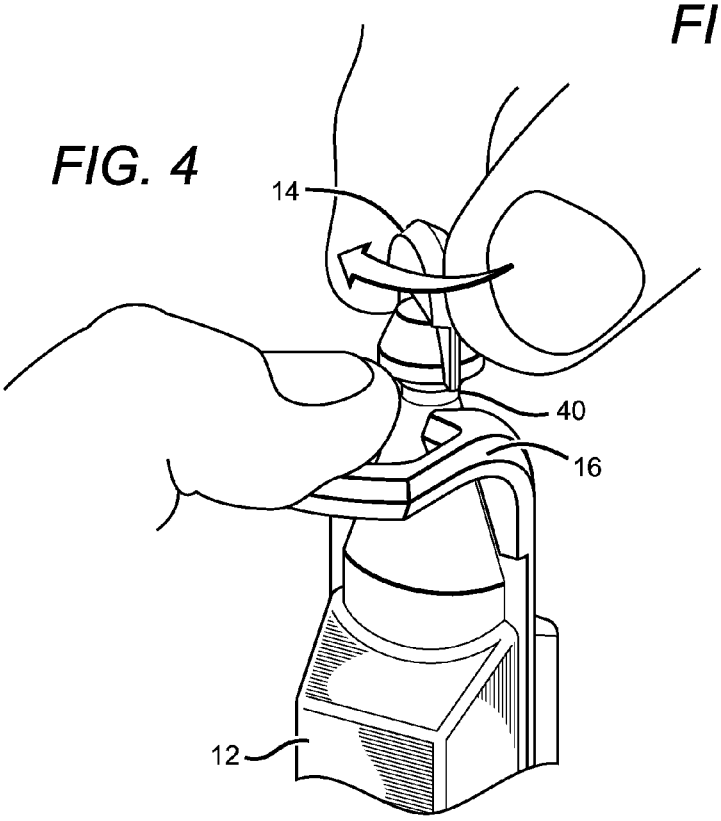

CHILD RESISTANT BLOW-FILL SEAL CONTAINER

CROSS REFERENCE TO RELATED APPLICATION

This application claims benefit to U.S. Provisional Application No. 61/953,084, filed Mar. 14, 2014, the entire content of which is hereby incorporated by reference herein in its entirety for all purposes.

BACKGROUND OF THE INVENTION

Blow-fill seal technology (BFS) refers to the manufacturing process used to produce various sized liquid filled vials ranging from as small as 0.1 mL to over 500 mL. Originally developed in Europe in the 1930s, it was introduced in the United States in the 1960s. Since the 1990s, BFS has become more prevalent within the pharmaceutical industry, and is now widely considered to be the superior form of aseptic processing by various medicine regulatory agencies including the U.S. Food and Drug Administration (FDA) in the packaging of pharmaceutical and healthcare products.

The basic concept of BFS is that a vial is formed, filled, and sealed in a continuous process without human intervention, in a sterile enclosed area inside a machine. Thus, BFS can be used to aseptically manufacture sterile pharmaceutical liquid dosage forms.

By way of example, machines sold under the trademark BOTTELPACK® by Rommelag® (www.rommelag.com) are used for production of various products using BFS. A machine sequence for the blow-fill seal process is described by Rommelag® as follows:

A plastic parison, extruded from polymer, is accepted by the opened blow mould and cut below the die of the parison head. The main mould closes and simultaneously seals the bottom. The special mandrel unit settles onto the neck area and forms the parison into a container using compressed air or vacuum. By way of the special mandrel unit, the product is precisely measured by the dosing unit and liquid is filled into the container. After the special mandrel unit retracts, the head mould closes and forms the required seal by vacuum. With the opening of the blow mould, the container exits from the machine and the cycle repeats itself.

U.S. Pat. No. 8,047,394 issued to Hansen discloses a safety device comprising a liquid medium which can be dispensed from a blow-molded vial utilizing the BOTTELPACK® process. In order to dispense the liquid, Hansen first requires that support points joining a head part to the vial body be broken and thereafter support points joining a head part to the vial body must be broken for removal of the head part exposing an opening for the liquid to be dispensed through. Hansen thus requires a two-step procedure for access to the liquid to be dispensed.

Hansen requires that an individual focus on the first step and once the support points of the first step have been broken, the individual can then focus on the support points of the second step. Because a child can focus its attention solely to breaking the support points of the first step and then to solely focus its attention on the second step, the current and predominant solution to making the product child-resistant is to incorporate secondary packaging. Such secondary packaging includes the use of foil wrap, over wrap, neck band, body band, etc. Unfortunately, implementation of secondary packaging increases manufacturing and labor costs, requires additional material, increases the time to manufacture, and further requires the use of multiple equipment as well as increased personnel training.

The required addition of secondary packaging which is necessary to ensure that a blow-fill seal constructed container is child-resistant has made sales of over the counter liquid medication in BFS packaging cost prohibitive.

SUMMARY OF THE INVENTION

Disclosed is a child resistant safety container made from blow-molded plastic using BFS manufacturing process. The produced blow-fill sealed container is child resistant and does not require secondary packaging as described earlier.

In development of my safety container, two issues were taken into consideration. First the intelligence of the individual attempting to open the packaging and secondly, the hand dexterity possessed by that individual. Hand dexterity is a skill which a child develops over time and is not likely to be possessed by infants or young children. My product design addresses both intelligence and hand dexterity issues solely in a BFS container, without the need or cost of secondary packaging.

The child resistant container comprises: a squeezable vial having an inner cavity and a neck with an outlet port; a removable cap positioned about the neck and covering the outlet port; and, a resilient guard having a first end, a second end and a mid-section having a bottom surface. Both ends of the resilient guard are integral to the vial on opposing sides and extend upward adjacent to the cap. In an initial position, the bottom surface of the mid-section is in close proximity to and faces the top surface of the cap. The resilient guard is designed to not be separated or broken off from contact with the vial at either end.

The plastic used for construction of the container utilizing blow-fill seal technology is any plastic known to those having skill in the art which can create the desired resiliency for the guard portion as well as the desired squeezability for the vial (i.e. to inwardly deform the vial thus reducing the cavity volume in response to a suitable force applied by thumb and forefinger to opposite sides of the vial). Preferably, the plastic used would be low density polyethylene, polypropylene, or copolymer blends thereof.

A pre-determined volume of aseptic fluid such as liquids or substances having a higher viscosity such as ointments or gels is contained within the cavity to either completely or substantially fill the cavity. The container can be used for both prescription medications as well as for over-the-counter liquid products. The fluid disposed or contained within the cavity can be any fluid suitable for use with BFS containers.

A seal is created by the BFS process securing the cap covering the outlet port to the vial to prohibit leakage and prevent fluid contamination. Preferably, the seal is hermetic. The hermetic seal can be formed by various designs well known by those having skill in blow molding technology. By way of examples, a hermetic seal can be formed by a continuous circumferential film of plastic between the cap and vial. Most preferably, the hermetic seal is between the cap and neck portion of the vial. Another example is circumferential lip and groove arrangement such as a groove in the cap mating to a lip present on the neck portion of the vial.

With the resilient guard in its original position, there is insufficient clearance between the cap and resilient guard mid-section to remove the cap from the neck and expose the outlet port. Frangible or break away support points, common in BFS manufacturing, are used to initially maintain the vial, cap, and resilient guard in its original configuration.

In order to dispense the fluid contained within the vial, a sufficient force must first be applied to overcome the resistance offered by a first plurality or set of breakable support points which define a first pre-determined point of separation. Thus, the first set of support points serve to counteract a detaching force with a first resistance that can be overcome. This first resistance is dependent upon the number and thickness of each support point.

As used in this specification, the terms "original" and "initial" when referring to the position of the resilient guard, means the position of the resilient guard before the first set of breakable support points are broken.

Overcoming the resistance means that the first set of support points are broken defining the first point of separation. This first point of separation allows the resilient guard to become bendable while both ends remain integral to the vial. Thus, the mid-section of the guard can be displaced away from its initial position, that being in close proximity to and having its bottom surface facing the top of the cap. Displacing the mid-section to a second position away from close proximity to the cap exposes the cap so it can be grasped and detached from the vial to expose the outlet port. Preferably, a thumb is used to maintain the mid-section of the resilient guard away from the top of the cap.

In addition to breaking the first set of support points, dispensing the liquid contained within the vial requires a sufficient force to then be applied to overcome the resistance offered by the hermetic seal which defines a second pre-determined point of separation. With the mid-section of the resilient guard in a second or displaced position, the exposed cap can be removed. The cap can be grabbed by the thumb and forefinger of the other hand and, depending on the type of hermetic seal design utilized, a twisting force can be applied to the cap sufficient to overcome the resistance offered by the plastic hermetic seal in the case of the seal being a continuous circumferential strip; or, the cap could be pulled away from the neck portion in the case of the seal being a circumferential lip/groove arrangement.

After the user breaks the hermetic seal which defines a second point of separation, the cap can be removed exposing the outlet port and the fluid within the vial can be discharged; preferably by squeezing opposing sides of the vial. If the guard is not held in a displaced position until the cap is detached and removed, the resiliency of the guard will cause the mid-section to return to substantially its initial position and be in close proximity again to the top of the cap. This would preclude any attempt to detach the cap. Thus, the term "close proximity" defines the relative position of the mid-section of the resilient guard to the cap so that the cap cannot be removed.

As used herein, the term "substantially its initial position" means the position of the resilient guard whereby the cap cannot be removed from the vial even though the first set of support points holding the cap to the resilient guard have been broken.

The child resistant container disclosed herein requires both intelligence and hand dexterity on the part of the individual and provides the necessary features for effective child safety. While a child may be able to break the support points holding the resilient guard in its initial position, the child must also possess the intelligence and hand dexterity to hold the mid-section of the guard in a bent position away from the cap with one hand and twist off the cap with the other hand at the same time. Thus, a critical component of the disclosed package is the resiliency of the guard. The resilient guard must be designed so that if the guard is bent and then released, it possesses sufficient resiliency to return substantially to its initial position and prevent removal of the cap, if the cap has not already been removed while the guard was in the bent second position.

In a preferred embodiment, my child resistant container consists of a vial having an inner cavity and a neck with an outlet port; a pre-determined volume of fluid contained within the vial; a cap detachable from the neck of the vial, preferably by twisting free; and, a resilient guard having a first and second end which are integral to the vial on opposing sides and extend upward adjacent to the sides of the cap. The resilient guard also has a mid-section integral with both the first end and the second end and is positioned initially over the top surface of the cap. This mid-section has a bottom surface adjacent to and facing the top surface of the cap. The resilient guard is designed to not be separated or broken off from contact with the vial. Frangible support points are used to secure the original position of the cap and resilient guard. The resilient guard, in its initial position, extends upward from the vial and about the outermost portion of the cap. A first set of support points is present for maintaining the position of the resilient guard to the cap. A pre-determined level of force is required to break the resilient guard from all support points attaching it to the cap. Following breaking from all support points, a sufficient force is applied to the mid-section of the resilient guard to bend the guard exposing the cap. While holding the guard in the bent position with the thumb of one hand, the cap is twisted with the forefinger and thumb of the other hand which breaks the hermetic seal attaching the cap to the neck of the vial. Thereafter, the cap can be removed exposing the outlet port through which the liquid contained in the vial can be discharged. Because the vial is made from a plastic having resilient qualities, discharge of the liquid contained therein occurs by squeezing opposite sides of the vial.

A single-use child resistant container is capable of delivering premeasured quantities of a fluid product, that may be liquid or semi-solid, that is economical to produce and suitable for the packaging of products such as foods and pharmaceuticals.

The unique feature of the child resistant container design is that it requires a user to do something more than simply grip the vial with one hand and twist off the cap with the other hand. The user must bend the resilient guard and hold in a bent position while gripping the vial with the same hand. The other hand is then free to twist off the cap, exposing the outlet port through which the fluid contained within the vial can be discharged. If the resilient guard is not bent, the close proximity or contact of the guard's mid-section to the top of the cap prevents removal of the cap since there is insufficient space between the top of the cap and the mid-section of the resilient guard for the cap to clear the neck portion of the vial.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

DESCRIPTION OF THE DRAWINGS

FIG. 1 is a perspective view of my BFS container;

FIG. 2 is a view along line 2-2 of FIG. 1;

FIG. 3 illustrates a bending force applied to the resilient guard exposing the cap;

FIG. 4 illustrates how the cap is removed;

FIG. 5 illustrates how the resilient guard will return to substantially its initial position upon release of the bending force.

DETAILED DESCRIPTION OF THE PREFERRED EMBODIMENT

The figures are provided for illustration purposes and are not necessarily drawn to scale.

The child resistant container is produced using blow-fill seal technology and can be manufactured in a multi-block form.

Figure 7:
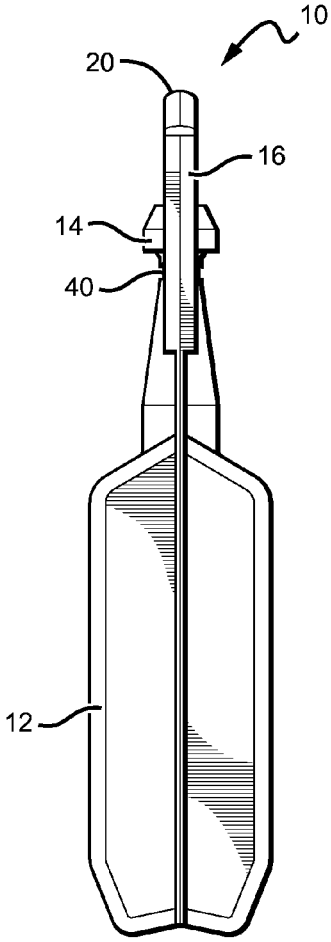
FIG. 7 is a side view of my BFS container.

Referring to FIG. 1, container 10 comprises a vial 12 with a neck 18. An interior cavity C is present which contains a pre-determined volume of fluid 13, illustrated in FIG. 2. FIG. 7 is a side view of container 10 in its original position.

Cap 14 is removeably connected to neck 18 and initially a hermetic seal 40 of plastic secures the cap to neck 18. When cap 14 is detached from vial 12, an outlet port P is exposed which allows fluid 13 to be discharged for use. Container 10 is manufactured from a plastic suitable for blow-mold operations. Dispensing the fluid contained within vial 12 occurs by applying pressure to opposing sides which squeezes the fluid out via outlet port P.

A resilient guard 16 is in the general shape of an inverted "U" where both ends are integrally formed with opposing sides of vial 12 and preferably to neck 18 as illustrated in FIG. 1. Guard 16, in its original or initial position, includes an integral mid-section 20 having a bottom surface 22 which faces and is adjacent to the top surface of cap 14. A first set of frangible support points 30 is present for maintaining resilient guard 16 in its initial position about cap 14. A pre-determined level of force is required to break support points 30 defining a first point of separation.

Following the breaking of the first set of support points, a bending force BF is applied to mid-section 20 which displaces mid-section away from close proximity with the top surface of cap 14, thus exposing the cap as shown in FIG. 3. While holding resilient guard 16 in a bent position using a thumb as illustrated in FIG. 4, cap 14 is then twisted using the thumb and forefinger of the other hand causing seal 40 connecting cap 14 to neck 18 to break and which defines a second point of separation. Following the breaking of seal 40, cap 14 can be removed from neck 18 thereby exposing outlet port P. The fluid contained within the interior cavity can be discharged by squeezing vial 12 and the fluid exits through outlet port P; preferably while the resilient guard remains bent.

If however, bending force BF to guard 16 is released before cap 14 can be grasped, the resiliency RF of guard 16 will return the guard to substantially its initial position as illustrated in FIG. 5. This resilient quality of guard 14 will prevent the removal of cap 14 because of the close proximity of the top surface of cap 14 to the bottom surface 22 of mid-section 20.

Figure 6:
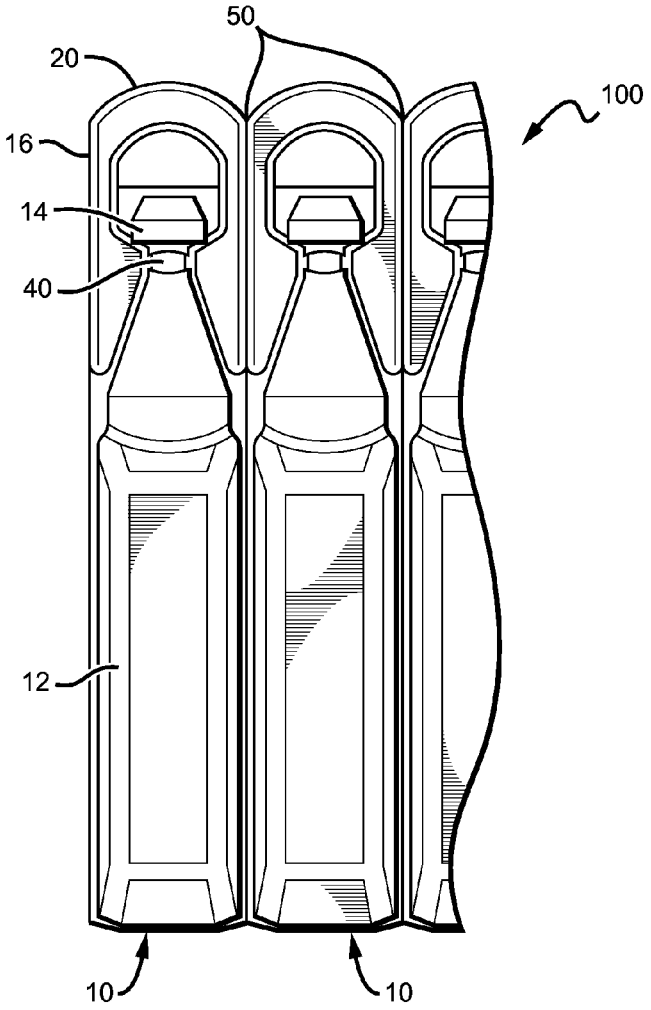
FIG. 6 is a front side view of a multi-block of BFS containers.
Figure 8:
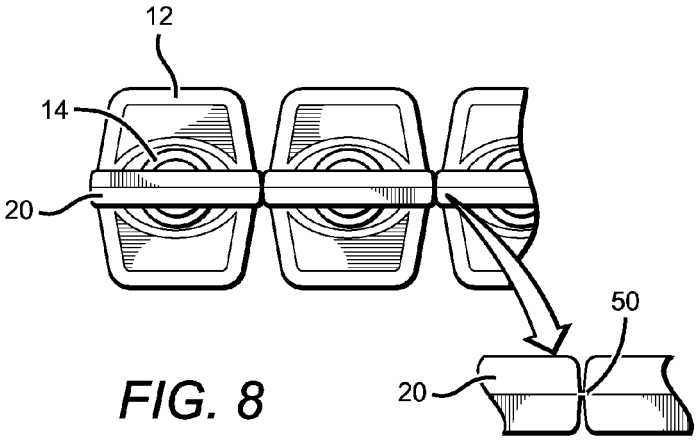
FIG. 8 is a top view of FIG. 6 having a close-up illustrating a support point.

FIGS. 6 and 8 illustrate a multi-block 100 of interlinked containers. Each container 10 is joined to one or to two other adjacent safety containers by a respective second set of breakable support points 50. This second set of support points is located along the sides of adjacent containers and each second set can be one or more support points along the length of each container.

I claim:

1. A child resistant container manufactured by a blow-fill seal process, comprising:

a squeezable vial with a single aperture and an interior cavity having a pre-determined volume of fluid contained within said cavity, where said aperture is the outlet port for dispensing said fluid from said vial;

a cap positioned about said neck and covering said outlet-port, said cap having a top surface distal from said outlet port;

a resilient guard having a first end, a second end and a mid-section having a bottom surface, both ends integral to said vial, said resilient guard having an original position in which the bottom surface of said mid-section faces and is in close proximity to the top surface of said cap, said resilient guard held in an initial position by a first set of breakable support points connecting said resilient guard to said cap, said first set of breakable support points defining a first predetermined point of separation, said first set of breakable support points further counteracting detaching forces with a first resistance that can be overcome for detaching said resilient guard from said cap and thereafter said resilient guard can be bent at least 45 degrees when a bending force is applied to said mid-section to displace said resilient guard away from said original position;

a seal between said cap and said neck, said seal defining a second predetermined point of separation, said seal counteracting opening forces with a resistance that can be overcome for breaking said seal and removing said cap to expose said outlet port; and, where said mid-section of the resilient guard will return to substantially its initial position when the bending force is removed from said mid-section.

2. The container of claim 1 wherein said safety container is joined to one or to two other adjacent safety containers by a respective second set of contact surfaces to form a multi-block.

3. The container of claim 1 where said seal is hermetic.

4. The container of claim 1 where said vial can be squeezed to reduce the volume of said cavity when said cap is removed.

5. The container of claim 1 where said resilient guard is U-shaped.

6. A blow-fill seal container, consisting of:

a squeezable vial having an interior cavity; a pre-determined volume of fluid contained within said squeezable vial, said vial further having a neck with an outlet port for dispensing said fluid;

a cap positioned about said neck and covering said outlet port, said cap having a top surface distal from said outlet port;

a resilient guard having a first end, a second end and a mid-section having a bottom surface, both ends integral to said vial, said resilient guard having an original position in which the bottom surface of said mid-section faces and is in close proximity to the top of said cap, said resilient guard held in an initial position by a first set of breakable support points connecting said resilient guard to said cap, said first set of breakable support points defining a first predetermined point of separation, said first set of breakable support points further counteracting detaching forces with a first resistance that can be overcome for detaching said resilient guard from said cap and thereafter said resilient guard can be bent at least 45 degrees so said mid-section is displaced away from said original position;

a hermetic seal between said cap and said neck, said hermetic seal defining a second predetermined point of separation, said hermetic seal counteracting opening forces with a resistance that can be overcome for breaking said hermetic seal and removing said cap to expose said outlet port; and, where said mid-section of the resilient guard will return to substantially its initial position when the bending force is removed from said resilient guard.

7. The blow-fill seal container of claim 6 wherein said safety container is joined to one or to two other adjacent safety containers by a respective second set of contact surfaces to form a multi-block.

8. The blow-fill seal container of claim 6 where said resilient guard is U-shaped.

9. A blow-fill seal container, comprising:

a squeezable vial having an interior cavity, and a neck having an outlet port;

a cap positioned about said neck and covering said outlet port, said cap having a top surface distal from said outlet port;

a resilient guard having a first end, a second end and a mid-section having a bottom surface, both ends integral to said vial, said mid-section facing and in close proximity to the top surface of said cap, said resilient guard fixed in an original position by connection to said cap by a first set of breakable support points, and when said first set of support points are broken and a bending force applied to said resilient guard, said mid-section can be bent at least 45 degrees to displace said mid-section away from being in close proximity to the top surface of said cap;

a hermetic seal securing said cap to said neck, and while said mid-section is displaced away from close proximity to said cap, said hermetic seal can be broken, and said cap removed, exposing said outlet port; and, where the bending force is removed, said mid-section will return to substantially its original position.

10. The blow-fill seal container of claim 9 where said resilient guard is U-shaped.

11. The blow-fill seal container of claim 9 further comprising a pre-determined volume of fluid disposed within said interior cavity.

12. The blow-fill seal container of claim 9 wherein said safety container is joined to one or to two other adjacent safety containers by a respective second set of contact surfaces to form a multi-block.

13. The blow-fill seal container of claim 12 further comprising a pre-determined volume of fluid disposed within said interior cavity.

14. A child resistant blow-fill seal container, comprising:

a squeezable vial having a neck and an interior cavity containing a pre-determined volume of fluid, said vial further having a single port located at said neck for dispensing said fluid;

a removable cap positioned about said neck and covering said outlet port, said cap having a top surface distal from said single port;

a resilient guard having a first end, a second end and a mid-section having a bottom surface, both ends integral to said vial, said resilient guard having an initial position in which the bottom surface of said mid-section faces and is in close proximity to the top surface of said cap preventing the removal of said cap, and a second position in which a bending force is applied to the resilient guard to bend at least 45 degrees so the bottom surface of said mid-section is displaced away from being in close proximity to the top surface of said cap whereby said cap can be removed to expose said single port; and, where said mid-section of the resilient guard returns to substantially its initial position when the bending force is removed.

15. The blow-fill seal container of claim 14 further comprising a first set of breakable support points connecting said resilient guard to said cap, and a hermetic seal connecting said cap to said vial.

16. The blow-fill seal container of claim 15 further comprising a pre-determined volume of fluid disposed within said interior cavity.

17. The blow-fill seal container of claim 14 where said resilient guard is U-shaped.

* * * * *